US007181041B2

(12) United States Patent
Koike

(10) Patent No.: US 7,181,041 B2
(45) Date of Patent: Feb. 20, 2007

(54) FLAT SPEAKER OF FULL-FACE DRIVING

(75) Inventor: Yoshio Koike, Tokyo (JP)

(73) Assignee: Foster Electric Co., Ltd., Tokyo (JP)

( * ) Notice: Subject to any disclaimer, the term of this patent is extended or adjusted under 35 U.S.C. 154(b) by 442 days.

(21) Appl. No.: 10/484,827

(22) PCT Filed: Jun. 20, 2002

(86) PCT No.: PCT/JP02/06170

§ 371 (c)(1),
(2), (4) Date: Jan. 22, 2004

(87) PCT Pub. No.: WO03/010997

PCT Pub. Date: Feb. 6, 2003

(65) Prior Publication Data

US 2004/0202347 A1 Oct. 14, 2004

(30) Foreign Application Priority Data

Jul. 23, 2001 (JP) ..... 2001-220999

(51) Int. Cl.
*H04R 25/00* (2006.01)

(52) U.S. Cl. ..... 381/401; 381/412; 381/431

(58) Field of Classification Search ..... 381/400, 381/401, 402, 408, 409, 410, 412, 431, 396
See application file for complete search history.

(56) References Cited

U.S. PATENT DOCUMENTS 4,334,127 A 6/1982 Shimada

FOREIGN PATENT DOCUMENTS

| | | | |
|---|---|---|---|
| DE | 30 24732 | A1 | 6/1980 |
| GB | 2 055 013 | A | 6/1980 |
| JP | 51-21816 | A | 2/1976 |
| JP | S51-21816 | | 2/1976 |
| JP | S54-107236 | | 7/1979 |
| JP | 56-7593 | A | 1/1981 |
| JP | S56-142197 | | 10/1981 |
| JP | S58-4309 | | 3/1983 |
| JP | 1-106700 | A | 4/1989 |
| JP | 09-224297 | | 8/1997 |
| JP | 2000-152378 | A | 6/2000 |
| JP | 2000-253489 | A | 9/2000 |

*Primary Examiner*—Curtis Kuntz
*Assistant Examiner*—Tuan Duc Nguyen
(74) *Attorney, Agent, or Firm*—Lynn & Lynn

(57) ABSTRACT

Ring magnets (5) are concentrically placed with certain spacings (6) on a magnetic frame (4). The magnetic members on the magnets (5) are removed, and the magnets are arranged so that the polarities of adjacent magnets (5)are alternately opposite to each other, thus forming a magnetic circuit. Ribs (7) are provided to a planar vibrating plate (1) and a voice coil (2) fabricated by vertically stacking conductive wires annularly is attached to the planar vibrating plate (1). The planar vibrating plate (1) is secured to a frame (4) through a gasket (3). The voice coil (2) is inserted into magnetic gaps of spacings (6). Since no magnetic body is placed over the magnets (5), the height of the magnetic circuit can be low, and an increase of the reactance due to provision of the magnetic body of the voice coil (2) does not occur. Since the rigidity of the planar vibrating plate (1) is high, it is unnecessary to secure the planar vibrating plate (1) to the frame (4) while applying a tension.

1 Claim, 6 Drawing Sheets

FLAT SPEAKER OF FULL-FACE DRIVING

TECHNICAL FIELD

This invention relates to flat speakers of full-face driving and, in particular, to a flat speaker of full-face driving adapted to ultra-thinning of small loudspeakers employed as mounted to portable or mobile telephones, notebook or lap-top personal computers and the like.

BACKGROUND OF ART

As the small loudspeaker mounted to the mobile telephones, lap-top personal computers and the like, such small dynamic loudspeaker having inner-magnet type magnetic circuit as shown in FIG. 6 has been widely employed. This small type loudspeaker is constituted by forming a magnetic gap with a yoke 14 and a plate 13, placing a magnet 15 on the yoke 14 and further the plate 13 made of a magnetic member thereon, and disposing a voice coil 12 coupled to a diaphragm 11 within the magnetic gap.

Now, the mobile telephones have been developed more and more in the multiplicity of types and functions, whereas still further minimization in the dimensions and weight has been demanded in view of the convenience of portability, and necessarily the small loudspeakers mounted thereto have been strongly demanded to be also small and ultra-thin.

Since such general dynamic loudspeaker as shown in FIG. 6 is of a driving system employing a single magnetic gap and a single voice coil, it becomes difficult to maintain required sound pressure level, frequency characteristics and so on as the dimensional and thickness minimization advances, and this type of the loudspeaker is limited in the possibility of response to the foregoing demands.

On the other hand, there has been known old such flat speaker of full-face driving as shown in FIG. 7 in its basic arrangement, in which a planar diaphragm 21 provided with a voice coil 22 is driven in the full face in equiphase with a plurality of magnets 25 disposed as dispersed on a plane board 23 having a plurality of holes 26, and which is featured in the capability of restraining occurrence of divided vibration and attaining flat frequency characteristics. However, this loudspeaker has been inferior in the conversion efficiency due to its structure, difficult to have both of a sufficient sound pressure and a wide band reproduction satisfied, almost limited in the usage to that as a tweeter, and unable to be used for the wide band. In manufacturing this type of the loudspeaker, further, it has been required to provide the diaphragm as glued in tense state, the planar diaphragm 21 has had to be fixed as adhered under a tension applied, and the workability has been extremely deteriorated.

In the small loudspeakers mounted to mobile telephones and the like, the conventional small loudspeaker of general dynamic type is unable to respond to the demand of minimization to be ultra-thin.

Since it is difficult to have both of the small and light-weight type as well as the sufficient sound pressure and wide band reproduction satisfied, the conventional flat speaker of full-face driving is not suitable for use as the small loudspeaker in the mobile telephone and lap-top personal computer.

The present invention has been suggested in view of such respects, and its object is to easily provide a flat speaker of full-face driving capable of realizing the sufficient sound pressure and wide-band reproduction even being the ultra-thin type, and responding to severe needs of the mobile telephone and the like.

DISCLOSURE OF INVENTION

In order to solve the above problem, the flat speaker of full-face driving of the present invention which comprising a plurality of magnets disposed to have magnetized directions mutually reversed in adjacent ones of the magnets or a plurality of magnetic gaps constituted to have magnetic flux directions mutually reversed in adjacent ones of the magnetic gaps, and a planar diaphragm, is characterized in that the plurality of magnets or the plurality of magnetic gaps are formed with respect to a frame comprised of a magnetic member, the plurality of magnets being respectively in similar or homothetic annular shape and disposed concentrically mutually with constant spacings maintained, and that the magnetic gaps for inserting therein a plurality of voice coils provided on the planar diaphragm are constituted within the spacings without provision of any magnetic member above the plurality of magnets or the plurality of magnetic gaps.

Further, the flat speaker of full-face driving of the present invention is characterized in that the plurality of voice coils are made by winding a conducting wire a plurality of times to be vertically stacked in a direction parallel with the thickness direction of the magnets.

Further, the flat speaker of full-face driving of the present invention is characterized in that the plurality of voice coils are connected, for at least two or more, in series, parallel or series-parallel connection.

Further, the flat speaker of full-face driving of the present invention is characterized in that the planar diaphragm is provided with ribs.

Further, the flat speaker of full-face driving of the present invention is characterized in that a yoke or yokes are arranged in place of the magnets mutually reversed in the direction of magnetization, so as to be reversed with each other in the direction of flux of adjacent ones of the magnetic gaps.

BEST MODE FOR CARRYING OUT THE INVENTION

The flat speaker of full-face driving according to the present invention eliminates the magnetic member on the magnet which has hindered the thickness minimization of the magnetic circuit, and constitutes the magnetic circuit with the magnets arranged to render the magnetized direction of adjacent ones of the magnets to be opposite to each other.

With the elimination of the magnetic member on the magnets, any increase in the reactance of the voice coil due to the presence of the magnetic member is excluded, and an improvement is attained in respect of the defect that the loudspeaker unit is deteriorated in the high frequency range by the magnetic member.

Further, a plurality of annular magnets are concentrically arranged and, in addition, the voice coils are constituted, instead of a plane printed wiring, but by means of conducting wires three-dimensionally wound into a vertical stack lying in the thickness direction of the magnets, with which arrangement the magnetic flux can be more efficiently utilized for improvement in the conversion efficiency.

In the followings, embodiments of the present invention shall be described to details with reference to the drawings.

Figure 1:
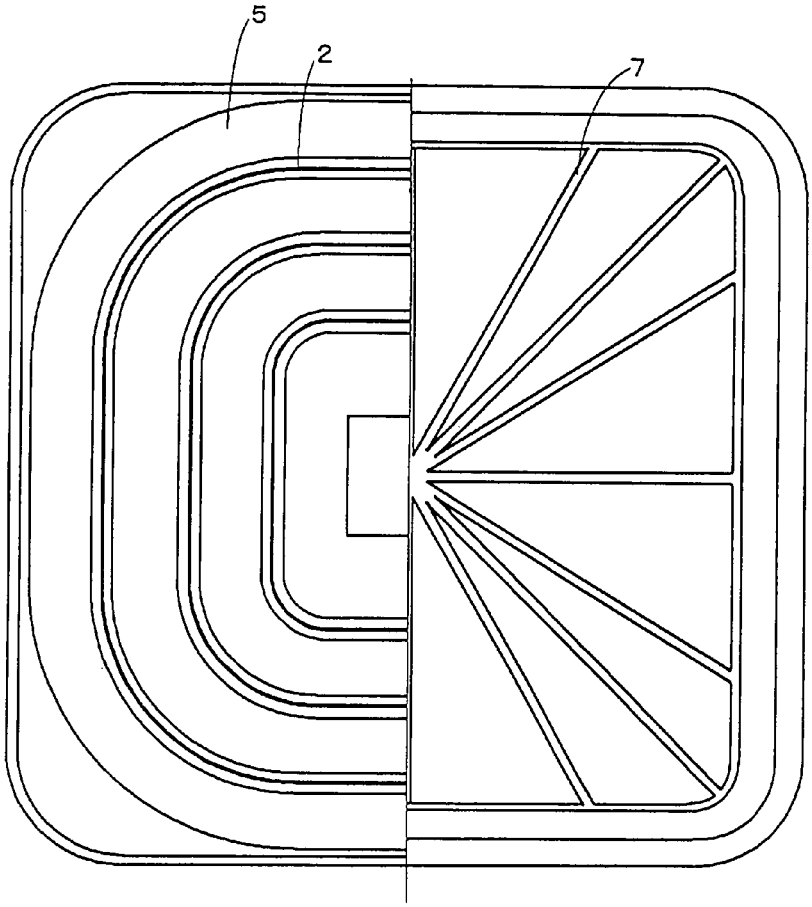
FIGS. 1(*a*) and 1(*b*) are diagrams showing an arrangement of the flat speaker of full-face driving in an embodiment of the present invention, in which FIG. 1(*a*) is a plan view with part of the diaphragm shown as omitted, and FIG. 1(*b*) is a sectioned view.
Figure 1:
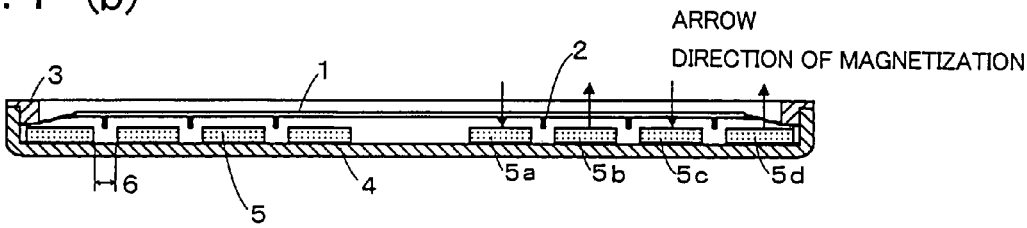

FIGS. 1(*a*) and 1(*b*) are diagrams showing an arrangement of the flat speaker of full-face driving in an embodiment of the present invention, wherein FIG. 1(*a*) is a plan view thereof shown with one left-hand half of the diaphragm omitted, and FIG. 1(*b*) is a sectioned view thereof.

The present embodiment is of the flat speaker of full-face driving of such ultra-thin type as about 25(W)×25(L)×2(H) mm, and employing four annular magnets 5 and three annular voice coils 2. In the planar diaphragm 1, radial and annular ribs 7 are formed.

On a frame 4 of a magnetic member, four annular magnets 5*a*–5*d* are arranged so as to mutually maintain constant spacings 6. Voice coils 2 are of the conducting wire wound annular for a plurality of times into the vertical stacks. The planar diaphragm 1 provided with the voice coils 2 is mounted into the frame 4 through a gasket 3.

Adjacent ones of the magnets 5*a*–5*d* are magnetized to be mutually in reverse direction. That is, in the sectioned view of FIG. 1(*b*), N-pole is positioned on the lower side in the magnet 5*a*, on the upper side in the magnet 5*b*, on the lower side in the magnet 5*c*, and on the upper side in the magnet 5*d*, respectively. Consequently, one of the magnetic circuits of the magnet 5*b* is formed through a path of the upper side of the magnet 5*b*→the gap 6→the upper side of the magnet 5*c*→the lower side of the magnet 5*c*→the frame 4→the lower side of the magnet 5*b*, while the other magnetic circuit of the magnet 5*b* is formed through a path of the upper side of the magnet 5*b*→the gap 6→the upper side of the magnet 5*a*→the lower side of the magnet 5*a*→the frame 4→the lower side of the magnet 5*b*.

A zone in which the magnetic flux gathers dense in each spacing 6 is the magnetic gap, in which each of the voice coils 2 is respectively inserted. Since no magnetic member is disposed on the magnets 5, the height of the magnetic circuits can be reduced by that extent, and this can be contributive to the minimization in the thickness and weight of the loudspeaker. Further, in contrast to with any narrow magnetic gap formed by the magnetic member normally disposed on the magnet, it is possible to make the gap wider, which lowers the possibility of the coil's hitting other members. Since no magnetic member is present nearby the voice coils 2, further, there is no increase in the reactance of the magnetic member. Therefore, it is possible to restrain the increase in the impedance of the loudspeaker in the high frequency range.

Figure 7:
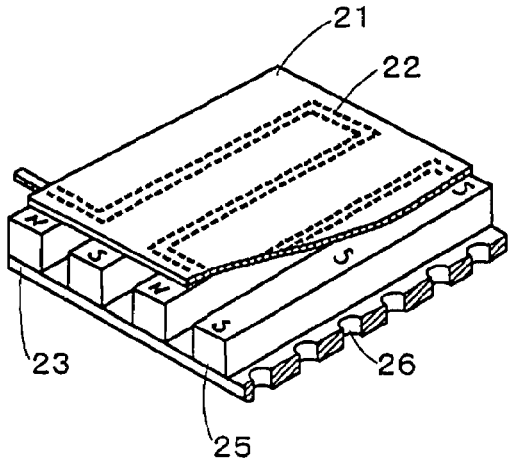
FIGS. 7(*a*) and 7(*b*) are to show a basic arrangement of conventional flat speaker of full-face driving, in which FIG. 7(*a*) is a perspective view at a main part thereof, and FIG. 7(*b*) is a perspective view showing an arrangement of magnets.
Figure 7:
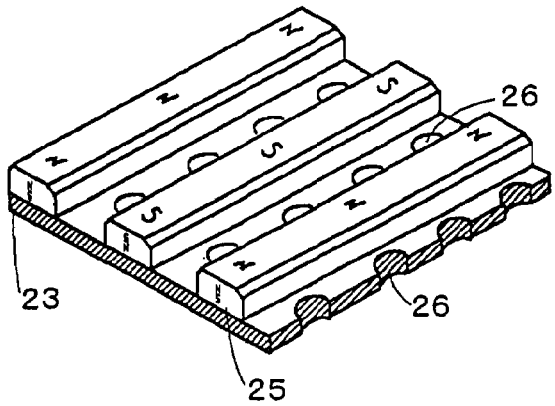

Since the plurality of magnets 5 are arranged annular and, in correspondence thereto, the plurality of voice coils 2 are also arranged annular, the voice coils are made to intersect the magnetic flux over the entire circumference, so as to eliminate any ineffective part of the coils in contrast to such conventional parallel arrangement of bar-shaped magnets as shown in FIG. 7. Further, as the voice coils are of the conducting wire wound by a plurality of times into the vertical stack instead of the planar printed wiring, so as to enter into the magnetic gaps, it is possible to improve the efficiency of magnetic flux utilization and to obtain sufficient sound pressure.

While the annular magnets of such appearance as shown in FIG. 1 where square shape in plan view is rounded at four corners are employed as the plurality of magnets 5 in the present embodiment, the magnets are not limited thereto but such various ones as those of rectangular, circular, elliptic, track-shaped and the like configuration may properly be employed. In order to maximize the driving force as much as possible within the existing dimensional restriction and to activate the advantage of the full-face driving to the maximum extent, the annular ones close to rectangular shape in the configuration are advantageous. Further, while the plurality of magnets 5 are respectively shown to be a single magnet of closed loop, such magnet may be further divided into a plurality of magnets arranged annular.

For the plurality of voice coils 2, further, either one of air-core coil and bobbin-wound coil will be applicable but, from the view point of the minimization in weight and so on, the air-core coil will be advantageous.

Further, the nominal impedance of the loudspeaker can be set optionally by means of series, parallel or series-parallel connection of the plurality of voice coils 2.

Since the ribs are formed in the planar diaphragm 1 to elevate the rigidity, any application of tension is no more required as in the case of conventional full-face driving type flat tweeter in mounting the planar diaphragm 1 to the frame 4, so as to be able to improve the workability and to obtain a loudspeaker of stable performance also in view of the acoustic characteristics.

Figure 2:
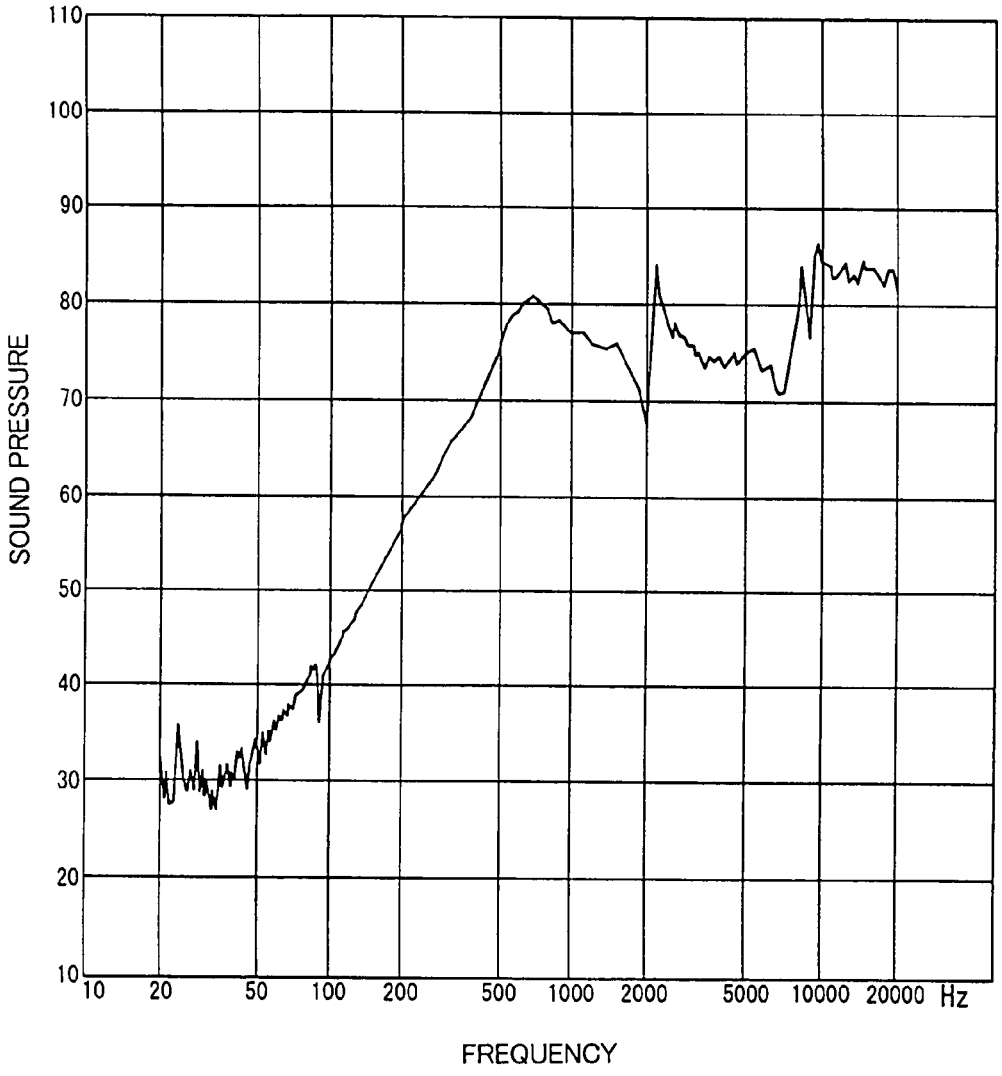
FIG. 2 is a diagram of sound pressure/frequency characteristics of the flat speaker of full-face driving according to the present invention.

FIG. 2 is a diagram of sound pressure/frequency characteristics of the flat speaker of full-face driving according to the present invention.

It has been confirmed that the reproduction of sufficient broad band and sound pressure level for use in the mobile telephone and lap-top personal computer can be obtained.

Figure 3:
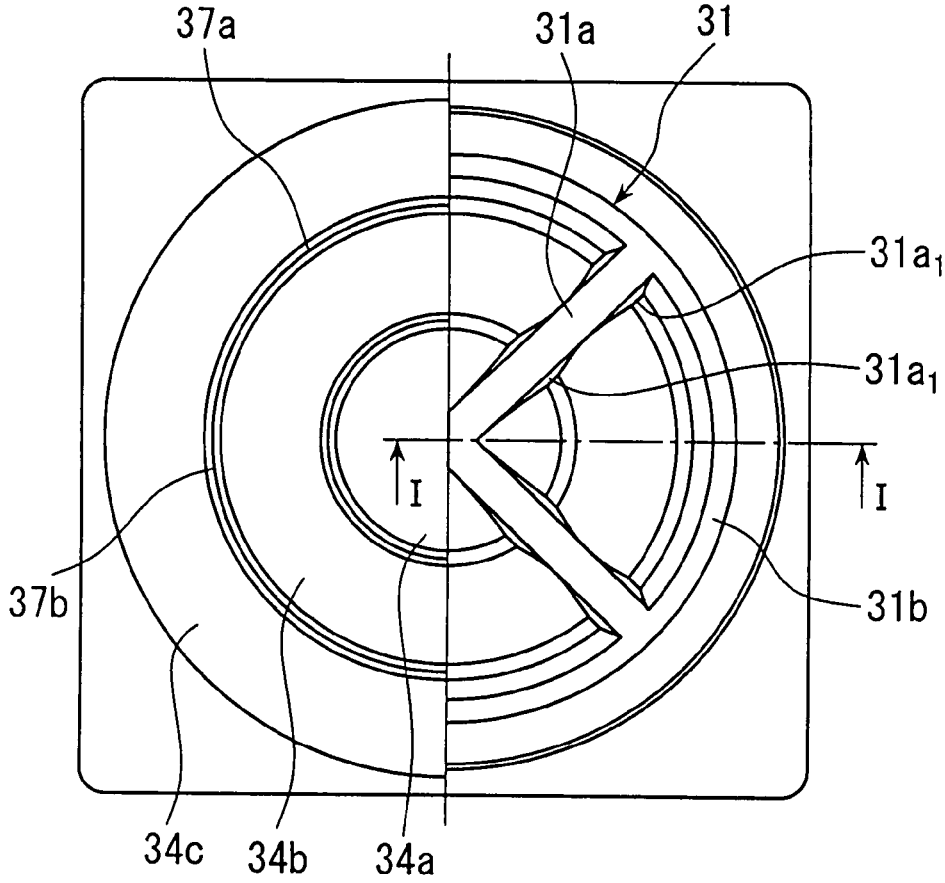
FIGS. 3(*a*) and 3(*b*) are diagrams showing an arrangement of the flat speaker of full-face driving in another embodiment of the present invention, in which FIG. 3(*a*) is a plan view showing a state in which one left-hand half of the diaphragm is omitted, and FIG. 3(*b*) is a sectioned view taken along I—I line in FIG. 3(*a*) as magnified.
Figure 3:
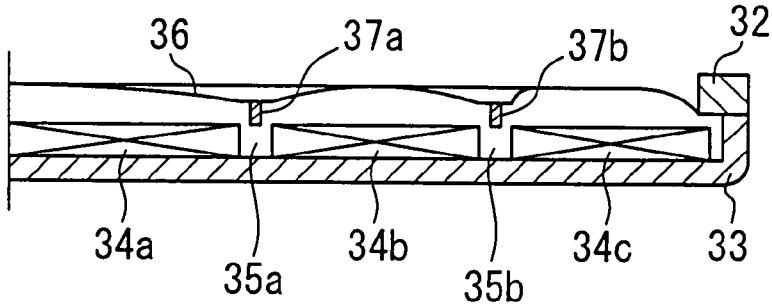

Other embodiment than that of FIG. 1 shall be explained next. FIGS. 3(*a*) and 3(*b*) are diagrams showing an arrangement of a flat speaker of full-face driving in another embodiment of the present invention, in which FIG. 3(*a*) is a plan view in a state where left-hand half of the diaphragm is omitted, and FIG. 3(*b*) is a fragmental sectioned view taken along I—I line in FIG. 3(*a*) as magnified. In the present embodiment, the ribs 31 comprise radial rib portions 31*a* and annular rib portions 31*b* disposed to intersect the radial rib portions 31*a*. In the present embodiment, further, bulges $\mathbf{31}a_1$ are provided to the radial rib portions 31*a* at concentric positions. These bulges $\mathbf{31}a_1$ are for the purpose of elevating the shape rigidity of the ribs 31. In FIG. 3, further, reference FIGS. 32, 33, 34*a*–34*c*, 35*a*–35*b*, 36 and 37*a*–37*b* denote gasket, frame, magnets, air gaps, diaphragm and voice coils, respectively.

Adjacent ones of the magnets 34*a*–34*c* are mutually reversed in the direction of magnetization. That is, in the sectioned view of FIG. 3(*b*), the N-pole is on the lower side in the magnet 34*a*, on the upper side in the magnet 34*b* and on the lower side in the magnet 34*c*. Therefore, one of the magnetic circuits of the magnet 34*b* is formed through a path of the upper side of the magnet 34*b*→ the gap 35*a*→ the upper side of the magnet 34*a*→ the lower side of the magnet 34*a*→ the frame 33 → the lower side of the magnet 34*b*, while the other magnetic circuit of the magnet 34*b* is formed through a path of the upper side of the magnet 34*b*→ the gap 35*b*→ the upper side of the magnet 34*c*→ the lower side of the magnet 34*c*→ the frame 33 → the lower side of the magnet 34*b*.

According to the present embodiment, similar to the embodiment of FIG. 1, the mounting of the diaphragm 36 to the frame 33 does not require such application of tension as in the conventional full-face driving type flat tweeter, so that a loudspeaker improved in the workability and showing a stable performance also from the view point of the audio characteristics can be obtained.

Further according to the flat speaker of full-face driving of the present embodiment, similar to the embodiment of FIG. 1, it is possible to attain sufficient wide band reproduction and sound pressure for use in the mobile telephones and lap-top personal computers.

Figure 4:
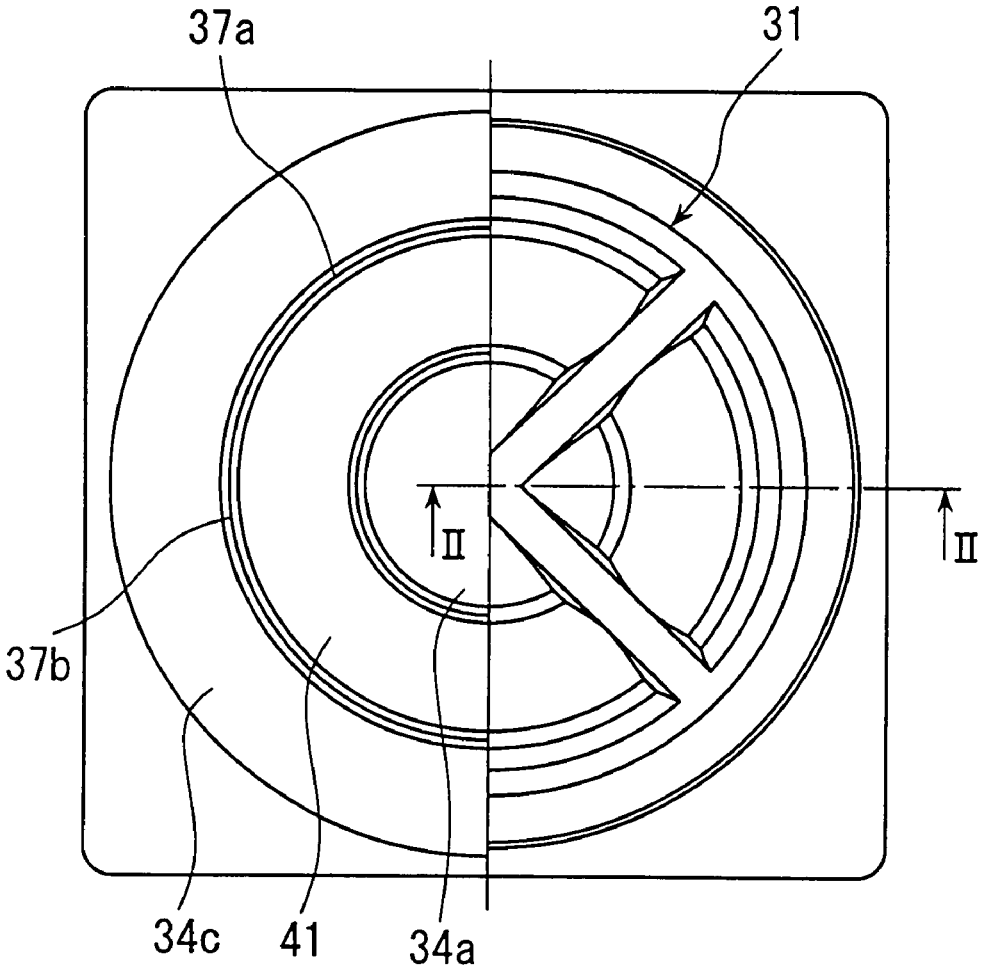
FIGS. 4(*a*) and 4(*b*) are diagrams showing an arrangement of the flat speaker of full-face driving in another embodiment of the present invention, in which FIG. 4(*a*) is a plan view showing a state in which one left-hand half of the diaphragm is omitted, and FIG. 4(*b*) is a sectioned view taken along II—II line in FIG. 4(*a*) as magnified.
Figure 4:
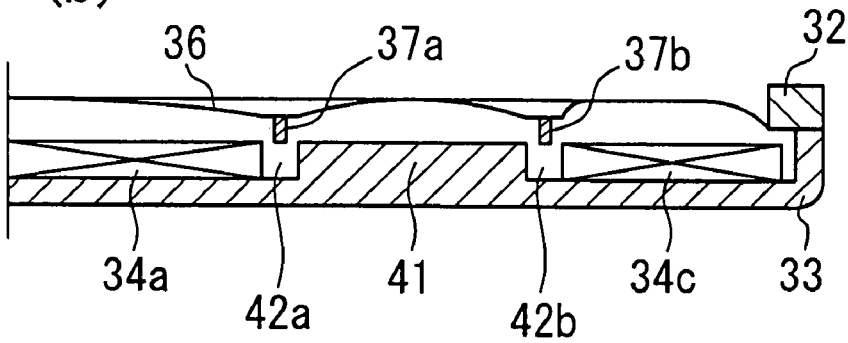

Next, the description shall be made with reference to other embodiment than those of FIGS. 1 and 3. FIGS. 4(*a*) and 4(*b*) show an arrangement of the flat speaker of full-face driving in another embodiment of the present invention, in which FIG. 4(*a*) is a plan view in a state where the left-hand half of the diaphragm is omitted, and FIG. 4(*b*) is a sectioned view taken along line II—II in FIG. 4(*a*) as magnified. In the present embodiment, an yoke 41 is provided in place of one 34*b* of the magnets in FIG. 3, which yoke 41 is formed in convexity with respect to the frame 33. The annular voice coils 37*a* and 37*b* are respectively disposed in each of the magnetic gaps in the gaps 42*a* and 42*b* between the yoke 41 and each of the annular magnets 34*a* and 34*c*.

In the present embodiment, adjacent ones of the magnetic gaps are mutually reversed in the direction of magnetic flux. That is, in the sectioned view of FIG. 4(*b*), the N-pole is on the lower side of the respective magnets 34*a* and 34*c*, so that the magnet 34*a* forms one magnetic circuit through a path of the lower side of the magnet 34*a*→ the frame 33 → the lower side of the yoke 41 → the upper side of the yoke 41 → the gap 42*a*→ the upper side of the magnet 34*a*, while the magnet 34*c* forms the other magnetic circuit through a path of the lower side of the magnet 34*c*→ the frame 33 → the lower side of the yoke 41 → the upper side of the yoke 41 → the gap 42*b*→ the upper side of the magnet 34*c*.

According to the present embodiment, similar to the embodiment of FIG. 1, the mounting of the diaphragm 36 with respect to the frame 33 does not require such application of tension as in the conventional full-face driving type flat tweeter, and the loudspeaker improved in the workability and having a stable performance also from the view point of the acoustic characteristics. According to the present embodiment, further, as the yoke 41 is employed instead of one 34*b* of the magnets 34*a*–34*c*, the step of mounting the magnet 34*b* can be eliminated. Further, with the use of the yoke 41, required manufacturing costs can be reduced.

According to the flat speaker of full-face driving, further, it is possible to attain the wide band reproduction and sound pressure level sufficient for the use in the mobile telephones and lap-top personal computers, similar to the embodiment of FIG. 1.

Figure 5:
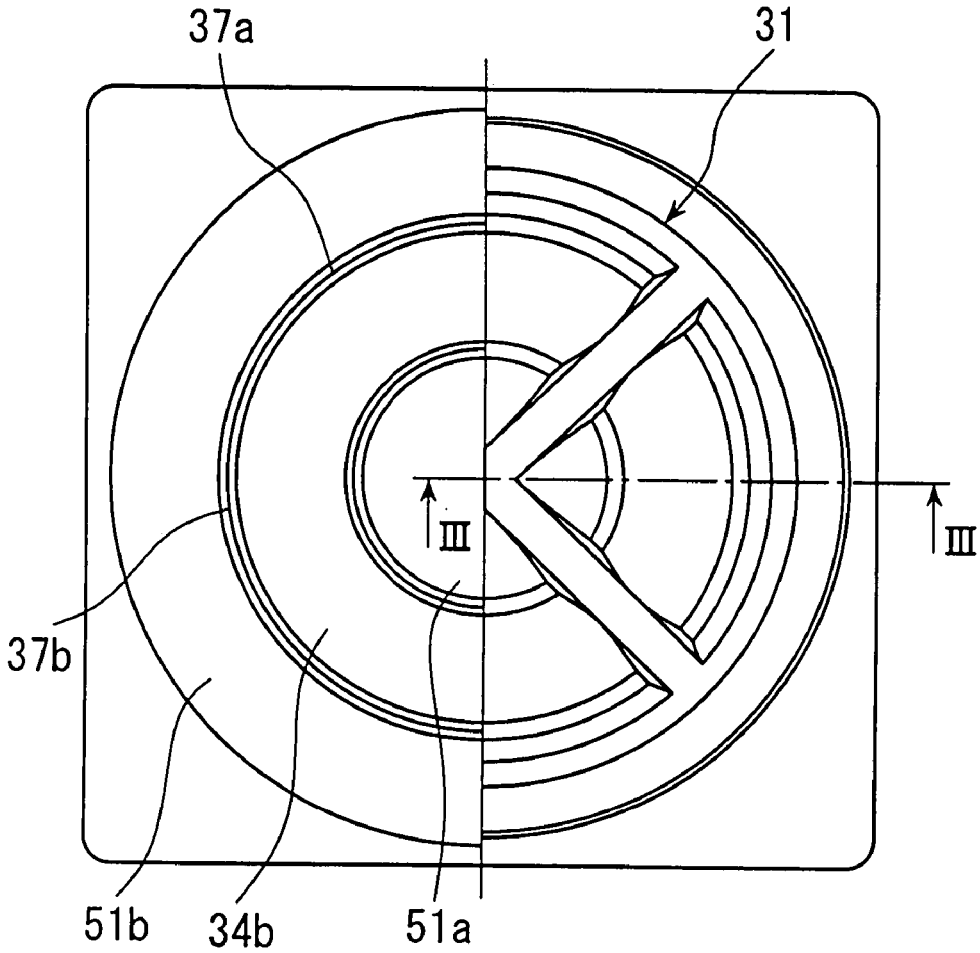
FIGS. 5(*a*) and 5(*b*) are diagrams showing an arrangement of the flat speaker of full-face driving in another embodiment of the present invention, in which FIG. 5(*a*) is a plan view showing a state in which one left-hand half of the diaphragm is omitted, and FIG. 5(*b*) is a sectioned view taken along III—III line in FIG. 5(*a*) as magnified.
Figure 5:
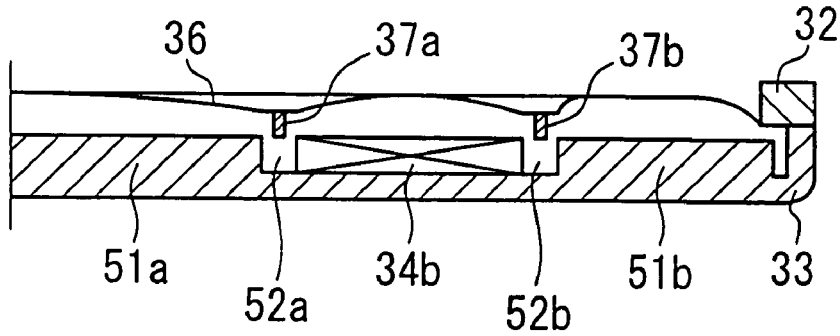
Figure 6:
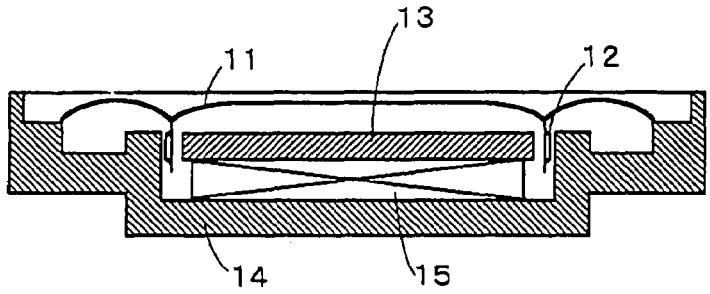
FIG. 6 is a sectioned view showing an example of a conventional small, dynamic loudspeaker for use in the mobile telephone.

Next, the description shall be made to other embodiment than those of FIGS. 1, 3 and 4. FIGS. 5(*a*) and 5(*b*) are diagrams showing an arrangement of the flat speaker of full-face driving in this another embodiment of the present invention, in which FIG. 5(*a*) is a plan view showing a state in which a left-hand half of the diaphragm is omitted, and FIG. 5(*b*) is a magnified sectioned view taken along line III—III in FIG. 5(*a*). In the present embodiment, yokes 51*a* and 51*b* are provided in place of two 34*a* and 34*c* of the magnets 34*a*–34*c* in the embodiment of FIG. 3. These yokes 51*a* and 51*b* are formed in convexity with respect to the frame 33. Voice coils 37*a* and 37*b* are respectively disposed in each of the gaps 52*a* and 52*b* between the yoke 51*a* and the magnet 34*b* and between the magnet 34*b* and the yoke 51*b*.

In the present embodiment, the adjacent ones of the magnetic gaps are reversed to each other in the direction of magnetic flux. That is, in the sectioned view of FIG. 5(*b*), the N-pole is on the upper side in the magnet 34*b*. Therefore, one of the magnetic circuits of the magnet 34*b* is formed through a path of the upper side of the magnet 34*b*→ the gap 52*a*→ the upper side of the yoke 51*a*→ the lower side of the yoke 51*a*→ the frame 33 → the lower side of the magnet 34*b*, and the other magnetic circuit of the magnet 34*b* is formed through a path of the upper side of the magnet 34*b*→ the gap 52*b*→ the upper side of the yoke 51*b*→ the lower side of the yoke 51*b*→ the frame 33 → the lower side of the magnet 34*b*.

According to the present embodiment, the diaphragm 36 does not require such application of tension as in the conventional full-face driving type flat tweeter for mounting the diaphragm to the frame 33, similar to the embodiments of FIGS. 1, 3 and 4, and the loudspeaker improved in the workability and of stable performance from the view point of acoustic characteristics can be obtained. Further according to the present embodiment, the use of the yokes 51*a* and 51*b* in place of the magnets 34*a* and 34*c* enables it possible to render the step of mounting the magnets 34*a* and 34*c* to be unnecessary. Further, with the use of the yokes 51*a* and 51*b*, required manufacturing costs can be reduced.

Further, it has been confirmed that, according to the flat speaker of full-face driving of the present embodiment, the wide band reproduction and sound pressure level sufficient for the use in the mobile telephones and lap-top personal computers can be obtained, similar to the embodiment of FIG. 1.

INDUSTRIAL APPLICABILITY

As has been described in the forgoing, the flat speaker of full-face driving of the present invention which comprises a plurality of magnets disposed to have magnetized directions mutually reversed in adjacent ones of the magnets, and a planar diaphragm, is characterized in that the plurality of the magnets are formed with respect to a frame comprised of a magnetic member respectively in similar or homothetic annular shape, as disposed concentrically mutually with constant gaps maintained, the magnetic gaps are formed in the spacing for inserting therein a plurality of voice coils provided on the planar diaphragm without provision of any magnetic member above the plurality of magnets, whereby the ultra-thickness minimization of the small loudspeakers mounted in the mobile telephones, lap-top personal computers and so on is made possible, and a full-range, flat speaker of full-face driving capable of obtaining the sufficient sound pressure level and wide band reproduction even being the ultra-thin type can be obtained.

Further, the workability in the mounting step of the diaphragm can be improved by the provision of the ribs to the planar diaphragm to elevate the rigidity, the manufacture is made easier, and it becomes possible to obtain stable and uniform performance.

Further, as the flat speaker of full-face driving of the present invention employs the yokes in place of the magnets mutually reversed in the direction of magnetization, it is possible to reduce the manufacturing costs.

The invention claimed is:

1. A flat speaker of full-face driving comprising a frame comprised of a flat plate-shaped member, a plurality of annular magnets concentrically disposed on one surface of the frame to have magnetized directions alternately reversed in relation to thickness direction of the magnets, a plurality of concentric annular magnetic gaps arranged to have magnetic flux directions respectively reversed from magnetic flux directions of adjacent ones of the magnetic gaps, a planar diaphragm fixed peripherally to a periphery of the frame while covering over the magnets and the magnetic gaps, and a plurality of voice coils respectively inserted in the magnetic gaps as disposed concentrically annularly on the planar diaphragm at positions corresponding to the magnetic gaps, characterized in that the planar diaphragm has a plurality of ribs radially extending from the center of the concentric annular voice coils and an annular rib connecting the radial ribs, and the plurality of voice coils are provided to the planar diaphragm as vertical-air coils made by the winding a conducting wire a plurality of times vertically stacked in a direction parallel with the direction of the magnets.

* * * * *